United States Patent [19]

Bianco

[11] 4,395,063

[45] Jul. 26, 1983

[54] SELF-INTERLOCKING DEAD BOLT ASSEMBLY

[76] Inventor: Eric L. Bianco, 405 E. First Ave., Roselle, N.J. 07203

[21] Appl. No.: 148,720

[22] Filed: May 12, 1980

[51] Int. Cl.[3] ..... E05B 9/02

[52] U.S. Cl. ..... 292/150; 292/169.21

[58] Field of Search ..... 292/163, 150, 169.14, 292/169.17, 169.21, 175

[56] References Cited

U.S. PATENT DOCUMENTS

| | | | |
|---|---|---|---|
| 1,748,599 | 2/1930 | Dermody | 292/169.14 |
| 3,696,744 | 10/1972 | Etchell | 292/163 X |
| 3,748,880 | 7/1973 | Atkins | 292/150 X |
| 3,792,887 | 2/1974 | Ramsey | 292/169.21 |
| 3,877,261 | 4/1975 | Robins | 292/150 |
| 4,183,585 | 1/1980 | Allemann | 292/150 X |

FOREIGN PATENT DOCUMENTS

| | | | |
|---|---|---|---|
| 1165677 | 6/1958 | France | 292/150 |

*Primary Examiner*—Francis K. Zugel
*Assistant Examiner*—Peter A. Aschenbrenner
*Attorney, Agent, or Firm*—Daniel H. Bobis

[57] ABSTRACT

A self-interlocking dead bolt assembly for the door on a safe depository or like security container has a dead bolt guide mounted on the inner face of the door and a bore extends end to end through the dead bolt guide to permit an elongated dead bolt of high strength steel to be slidably mounted in said bore and movable to extend beyond said dead bolt guide for engagement with a strike or keeper to lock the door when it is in the closed position, and the bore has a locking groove inwardly of this end of the bore. The dead bolt has an inner bore or chamber which defines an annular wall thereon having a spaced plurality of sized transverse passages therethrough at a predetermined medial position. A corresponding plurality of sized ball members mounted in the transverse passages are actuated by a suitable actuating assembly in said inner bore to move radially outward on movement of the dead bolt to the locked position when the transverse passages are brought into alignment with the locking groove to self interlock the dead bolt in this locked position. The actuating assembly must be moved in a direction to cause the ball members to be released from the locking groove before the dead bolt can slide from the locked to the unlocked position. The actuating assembly desirably includes a breakaway device to insure against unauthorized tampering with the dead bolt assembly or door of the safe depository or like security container.

Further, the combination of the above described self interlocking dead bolt assembly with an operatively associated operating lever or live bolt forming part of a suitable operating mechanism such as a combination lock affixed to and extending through from the inner face to the exterior face of the door for direct drive movement of the actuating assembly of the self interlocking dead bolt assembly.

22 Claims, 9 Drawing Figures

SELF-INTERLOCKING DEAD BOLT ASSEMBLY

BACKGROUND OF THE INVENTION

This invention relates generally to locking devices for safes or the like security containers and more particularly to a self interlocking dead bolt assembly applicable to such devices and other types of doors where it is desirable to maintain the dead bolt of the dead bolt type locking assembly in its locked position.

In a dead bolt locking mechanism having a direct drive as is known in the prior art certain problems have developed. First, such locking mechanisms stick or present opening or closing difficulties from time to time due to misalignment of the parts or due to nose pressure on the live bolt. Second, these locks can be rendered ineffective by thieves as by punching the side casing of the safe depository or security container so as to gain access to the dead bolt portion of the mechanism and move the same to an unlocked position thereby permitting such thieves to open the safe depository or security container.

In efforts to overcome these problems various known prior art devices have been designed and manufactured but such prior art devices are so complicated that they are expensive to manufacture and sell.

The present invention provides a relatively simple, low cost, self interlocking dead bolt assembly for the door of a safe depository or like security device in which the dead bolt therein is slidably mounted in a dead bolt guide and has operatively associated means which is self actuating to lock the dead bolt in the closed or locked position so that the dead bolt cannot be moved from the locked position to an unlocked position until the self actuating interlocking mechanism is deactivated or released to permit the dead bolt to be moved to such unlocked position.

The self interlocking dead bolt assembly in accordance with the present invention will be constructed to permit the application of some tension on the live bolt in the associate mechanism for operating the self interlocking dead bolt assembly to avoid nose pressure on the live bolt.

Further, a breakaway device may be provided to prevent unauthorized tampering with the self interlocking dead bolt.

SUMMARY OF THE INVENTION

Thus the present invention covers a self interlocking dead bolt assembly for the door of a safe depository or like security container comprising, a dead bolt guide fixedly connected to the inner face of the door having a dead bolt bore extending end to end therethrough with a locking groove formed inwardly of one end of said bore, a dead bolt slidably mounted in said dead bolt bore and having a length substantially greater than said dead bolt guide so that the dead bolt extends past the locking groove end of said dead bolt guide, said dead bolt includes, an elongated bore which defines an annular wall on said dead bolt, a plurality of transverse passages disposed in said annular wall a predetermined distance inwardly of the end of the dead bolt guide, and a corresponding plurality of sized ball members are slidably disposed in said transverse passages to align and engage with the locking groove when the dead bolt is moved to the locked position, an actuating assembly is connected in the elongated bore of the dead bolt for moving said dead bolt and for actuating said ball members to slide through said transverse passages into engagement with the locking groove to lock the dead bolt in the locked position, and said actuating assembly movable in a reverse direction to first release the ball members and then to move the dead bolt from the locked to unlocked position.

The self interlocking dead bolt assembly as above described having a coupling on the actuating means to couple the dead bolt to an associated live bolt on an operating mechanism to move the dead bolt wherein the coupling will exert limited tension on the live bolt to eliminate nose pressure thereon.

The self interlocking dead bolt assembly as above described including means on said actuating assembly defining a breakaway device in the event that lateral or twisting movement is applied as by unauthorized tampering with the self interlocking dead bolt assembly, the associated operating mechanism therefore or the door of the safe depository or like security container.

Accordingly, it is an object of the present invention to provide an improved self interlocking dead bolt assembly for the door of a safe depository which is relatively simple in operation and relatively cheap to manufacture.

It is another object of the present invention to provide a self interlocking dead bolt assembly which interlocks the dead bolt thereof in the locked position and requires an actuating assembly to deactuate the interlocking mechanism and to move the dead bolt from the locked to unlocked position.

It is another object of the present invention to provide a self interlocking dead bolt assembly in which the coupling mechanism between the dead bolt thereof and the live bolt of the associated direct drive operating mechanism can exert limited tension on the live bolt to prevent nose pressure thereon.

It is a still further object of the present invention to provide a self interlocking dead bolt assembly having a breakaway means thereon to prevent unauthorized tampering therewith.

With this and other objects and advantages in view the invention will be understood to consist of certain details of construction as described with respect to one form of safe depository as shown in the accompanying drawings.

DESCRIPTION OF THE FIGURES

Referring to the drawings FIG. 1 shows a safe depository or like security container designated 10 for defining a security space 11 therein in which articles, jewelry, documents, etc. are placed for safekeeping.

Figure 1:
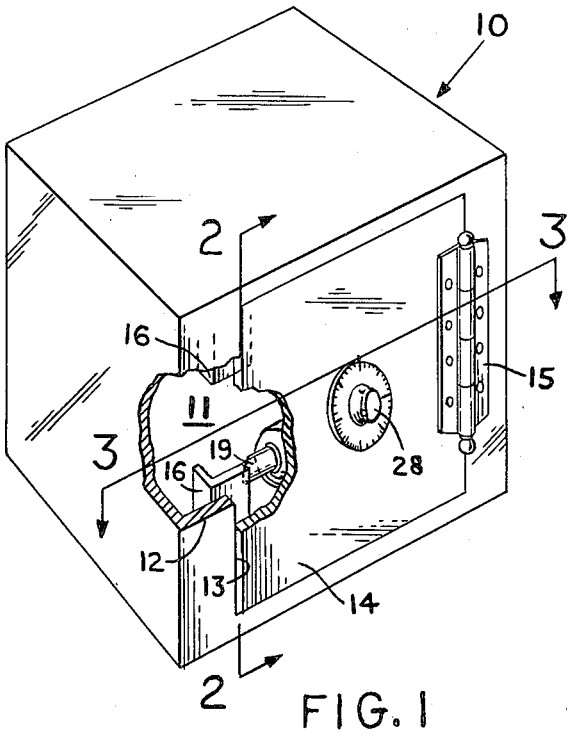
FIG. 1 is a perspective view partly in section of a safe depository on which a self interlocking dead bolt assembly in accordance with the present invention is utilized.

The security container 10 has a front panel or section 12 having opening 13 therein and a door 14 hingedly mounted as at 15 on the front panel is disposed to be moved into and out of engagement with the opening 13 so as to open and close the same so as to provide access to the security space 11 when the door 14 is in the open position and to lock the security space against access in the closed position as will be understood by reference to FIGS. 1, 3, 5 and 6 of the drawings.

Figure 2:
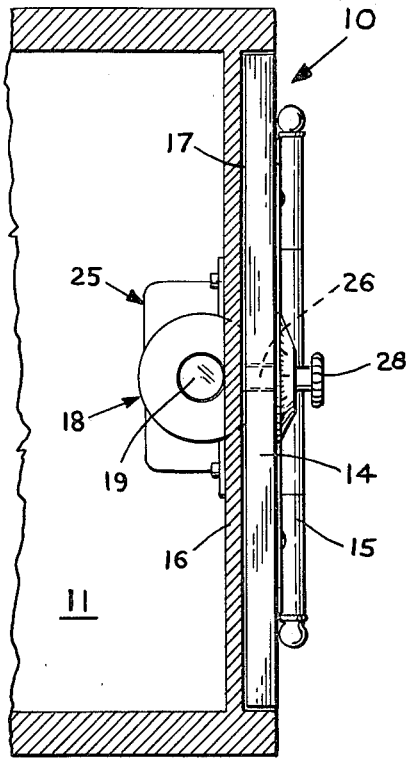
FIG. 2 is a side view taken on line 2-2 of FIG. 1 and showing the left side of the self interlocking dead bolt assembly shown in FIG. 1 of the drawings.
Figure 3:
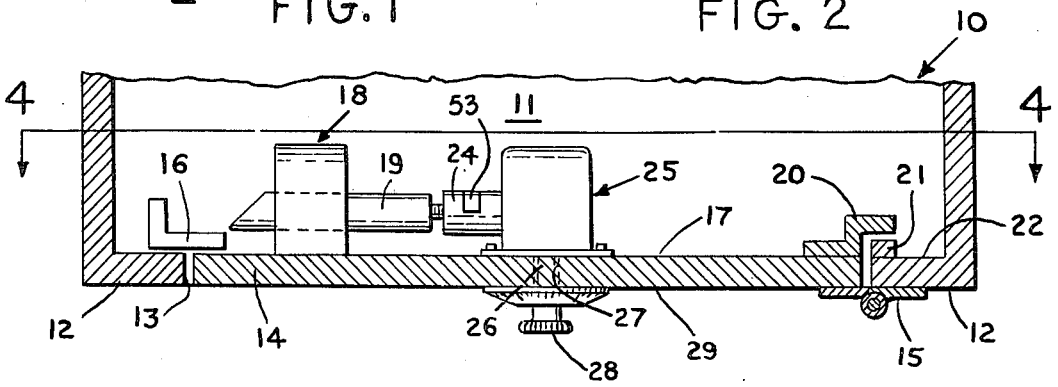
FIG. 3 is a top plan view taken on line 3-3 of FIG. 1 showing the self interlocking dead bolt assembly as mounted on the inner face of the door of the safe depository shown in FIG. 1.
Figure 4:
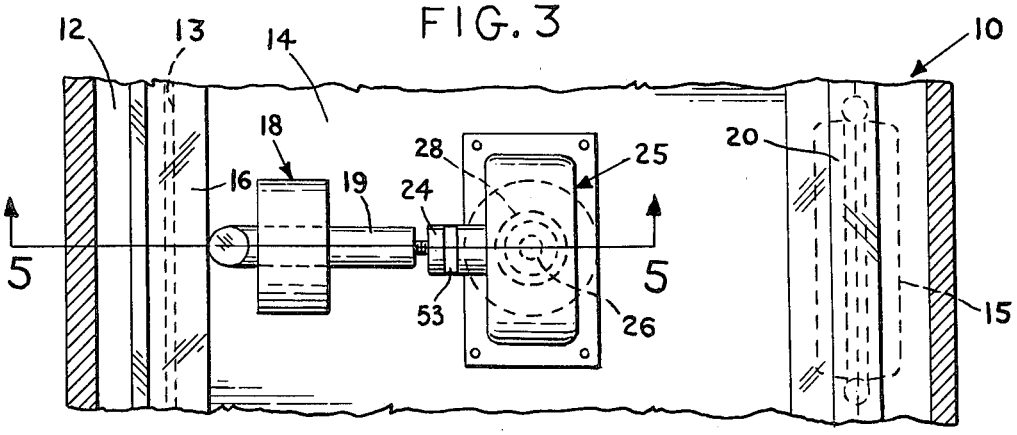
FIG. 4 is a back view of a portion of the door and front section of the safe depository in the closed position taken on line 4-4 of FIG. 2 with the self interlocking dead bolt assembly in the open position.

The front panel or section 12 is provided with a strike or keeper 16 at one side thereof and as shown in FIGS. 1, 2 and 4 the inner face 17 of the door 14 will engage the strike or keeper when the door is moved to the closed position.

Mounted on the inner face of the door 14 is one form of self interlocking dead bolt assembly generally designated 18 in accordance with the present invention. The self interlocking dead bolt assembly 18 will be so disposed on the inner face of the door 14 that when the dead bolt 19 thereon is moved to the locked position as shown in FIGS. 1 and 4 of the drawings, the dead bolt will engage the strike or keeper 16 and will firmly hold the door 14 in the closed position.

Figure 6:
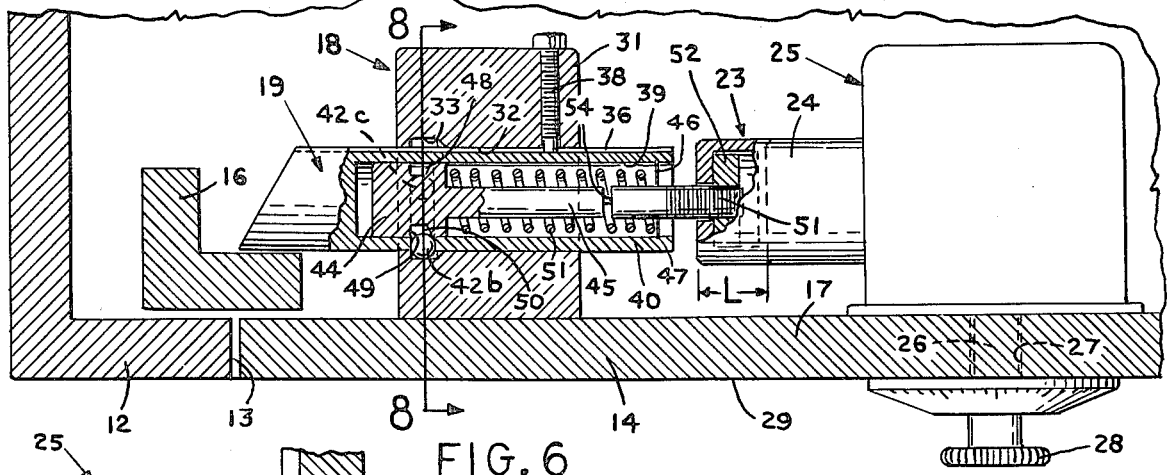
FIG. 6 is the same view as FIG. 4 showing the self interlocking dead bolt assembly in the locked position.

Further it will be noted that door 14 on the side remote from the keeper 16 is provided with a Z-shaped elongated bar as at 20 which is so sized and mounted on the inner face 17 of the door 14 that it will clear a coacting support bar 21 on the inner face 22 of the front panel 12 adjacent the opening 13 therein on the same side as the Z-bar 20. In other words the door 14 can easily pivot on the hinge 15 from the closed to open position and vice versa without interference from the Z-bar 20. However, in the closed or locked position as shown in FIGS. 1 and 6, it is impossible for a thief or other unauthorized person to gain entry to the safe depository or like security container by removing the door 17 as long as the self interlocking dead bolt 19 is holding the door 14 in the closed or locked position.

The self interlocking dead bolt assembly which is more fully described below is connected by any suitable type of direct coupling generally designated 23 to an operating member or live bolt 24 which in turn is operated or driven by a combination lock assembly generally designated 25 so as to exert a slight tension on the line bolt 24 for reasons also more fully described below.

The combination lock assembly 25 will also be mounted by any suitable means on the inner face 17 of the door 14 so that the operating shaft 26 thereof can extend through an opening 27 through the door 14 for connection to a suitable operating dial and handle generally designated 28 disposed on the outer or exterior face 29 of the door 14.

The combination lock assembly 25 having the operating member or live bolt 24 thereon as is illustrated in the drawings is a well known device which is easily purchaseable on the open market and the operation of which is readily understood by both persons skilled in the art and unskilled persons. Therefore it is not deemed necessary to describe the structure and operation of such combination lock assembly in any great details for the purposes of the present invention.

Those skilled in the art will readily understand that by operating the dial and handle 28, the operating member or live bolt 24 on the combination lock assembly 25 can be positioned to move the dead bolt 19 from the unlocked to the locked position and vice versa so that the door 14 can be operated so as to open or close the opening 13 in the front panel section 12 of the safe depository 10 thus permitting access to the security space or the locking of the security space as may be desired in connection with the use of the safe depository 10.

The structure and operation of the self interlocking dead bolt assembly 18 which is coupled to, actuated and operated by the combination lock assembly 25 will now be described with reference to FIGS. 5 to 9 of the drawings, including the coupling device between these elements which acts to prevent nose pressure on the live bolt 24 of the combination lock assembly 25.

SELF INTERLOCKING DEAD BOLT ASSEMBLY

Self interlocking dead bolt assembly 18 is affixed in assembled position by means of dead bolt guide 31 which is a relatively large boss connected as by welding to the inner face 17 of the door 14. Dead bolt guide 31 must be fixed in predetermined relation to the strike 16 so that in the unlocked position the dead bolt 19 will clear the strike 16 and the door 14 will be permitted to move into and out of engagement with the strike as the door opens and closes the opening 13 in the front panel 12 of the safe depository 10.

The dead bolt guide 31 has a bore 32 extending end to end therethrough and adjacent the end of the bore closest to the strike a locking groove 33 is formed just inwardly of the end thereof.

The locking groove 33 has a first transverse face 34 on the side adjacent the strike and a second transverse face 35 on the side thereof remote from the strike. First transverse face 34 is substantially perpendicular to the bore 32. The second transverse face 35 is chamfered at an angle of approximately 60° to the longitudinal axis of the bore 32. The purpose and function of the respective first transverse face 34 and second transverse face 35 will be clear in connection with the operation of the self interlocking dead bolt assembly as hereinafter described.

The dead bolt 19 is an elongated cylindrical element slidably mounted in the bore 32 of the dead bolt guide 31 so that an elongated slot on the outer periphery thereof is disposed in alignment with a threaded bore 37 in the dead bolt guide to permit threaded bolt 38 mounted therein to engage the elongated slot 36. As the dead bolt 19 moves to and fro in the bore 32 the threaded bolt 38 will prevent the dead bolt from rotating.

The dead bolt 19 is substantially longer than the width of the dead bolt guide 31. Therefore when slidably mounted in the bore 32 the dead bolt 19 extends beyond the respective opposite sides of the dead bolt guide 31 as is shown in FIGS. 1, 2, 4, 5, and 6 of the drawings.

FIGS. 1, 2, 4, 5, 6 and 9 show that the end of the dead bolt 19 adjacent to the strike is solid and relatively strong so that when the dead bolt 19 is moved into engagement with the strike as hereinafter described it will hold the door securely in the locked position. Further, extending in from the opposite end of the dead bolt 19 is an elongated bore or chamber 39 which defines an annular wall 40 in which at a predetermined medial point thereof are a plurality of spaced transverse and aligned passages as at 41*a*, 41*b* and 41*c*. Slidable respectively in the passages 41*a*, 41*b* and 41*c* are a corresponding plurality of sized ball members as at 42*a*, 42*b* and 42*c*.

The ball members 42*a*, 42*b* and 42*c* are retained and moved by an actuating assembly 42 in the elongated bore or chamber 39. The actuating assembly 43 connects the dead bolt 19 to the live bolt 24 so as to operate and move the dead bolt and is also movable relative the dead bolt to obtain the desired self interlocking action of the present invention.

Thus by reference to FIGS. 5 to 9 the actuating assembly 43 is shown as including, a plunger section 44 disposed in the elongated bore or chamber 39 which is connected to one end of a push rod 45 lying in the longitudinal axis of the elongated bore or chamber 39 and extending outwardly thereof through a retaining type spring washer 46 embedded in the annular wall adjacent the end of the elongated bore or chamber 39 remote from the strike end of the dead bolt 19. The retaining spring washer 46 acts to hold one end of a resilient member 47 disposed about the push rod 44, the other end of which resilient member will engage the plunger section 44 and act continuously to normally urge the plunger section 44 towards the aligned transverse passages 41*a*, 41*b* and 41*c*.

The plunger section 44 is a cylindrical member having a diameter slightly less than the diameter of the elongated bore or chamber 39 and a length to permit the formation in the periphery thereof of a circumferential groove 48 in which the ball members 42*a*, 42*b* and 42*c* are caged and confined by the annular wall 40 during sliding movement of the plunger section 44 in the elongated bore or chamber 39. The circumferential groove 48 also has a first transverse face 49 substantially perpendicular to the longitudinal axis of the elongated bore or chamber 39 and spaced therefrom a second transverse face 50 chamfered at an approximate angle of 60° to the axis of the elongated bore or chamber 39. This construction will permit the resilient member 47 about the push rod 45 and disposed between the embedded spring washer 46 at one end and the plunger section 44 at the opposite end to continuously act to normally force the plunger section 44 so that the circumferential groove 48 during movement of the plunger section 44 will at some point come into alignment with the inner end of the plurality of transverse openings 41*a*, 41*b* and 41*c*. The second transverse surface 50 in the aligned position acts to move the ball members 42*a*, 42*b* and 42*c* radially outward into the respective plurality of transverse passages 41*a*, 41*b* and 41*c* all of which is shown in FIGS. 5, 6, 7, and 8 of the drawings.

Figure 5:
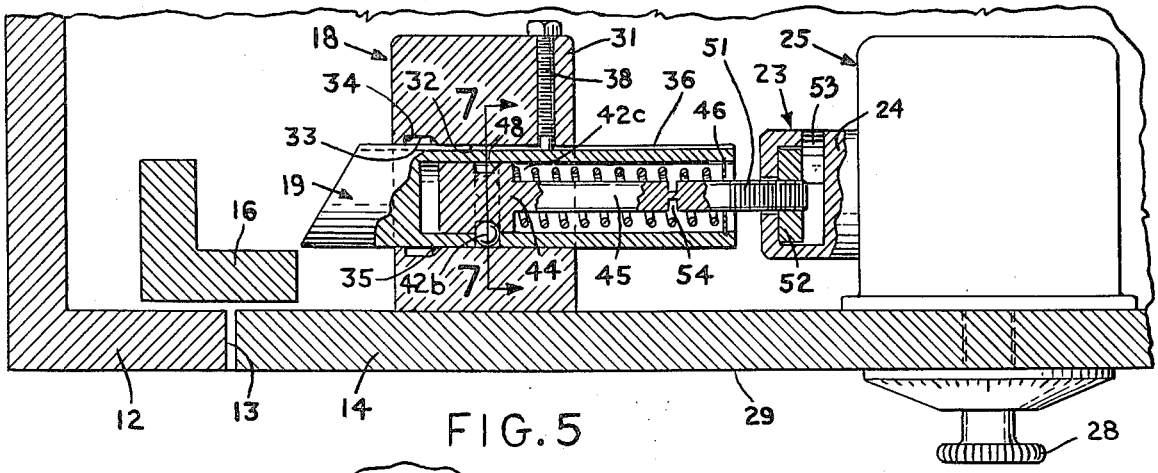
FIG. 5 is an enlarged horizontal section taken on line 5-5 of FIG. 4 showing the self interlocking dead bolt assembly in the unlocked position and the coupling between the actuating assembly and the live bolt of the associated mechanism for operating the dead bolt assembly.

FIGS. 5 and 6 show that the push rod 45 extends outwardly of the open end of bore 39 and that the extended end is threaded as at 51 to provide means for mounting a threaded coupling nut 52 thereon.

Coupling nut 52 will in turn be disposed for engagement with a T-slot 53 in the end of the live bolt 24 which lies adjacent thereto. In this assembled position the threaded nut 52 can be rotated until it exerts a limited amount of tension on the live bolt by reason of the action of the resilient element 47. The object of this coupling arrangement is to insure against nose pressure acting or developing on the live bolt 24. Those skilled in the art will readily recognize that where nose pressure develops on the live bolt that this affects the operation of the combination lock assembly 25 in that it may cause a hang up of the locking dog or the cross pin connected thereto which fits into the slots on the tumblers, not shown, of the combination lock assembly 25.

It will be understood that the push rod 45 will desirably include a necked down section as at 54 thereon which forms a breakaway device. If any undue lateral force or twisting force is applied to the dead bolt 19 or the combination lock assembly 25, the breakaway section 54 will fracture and the dead bolt 19 will be forced to remain in the locked position. Thus the present invention prevents unauthorized entry or tampering with the safe depository or like security container.

In the position as shown in FIG. 5 the dead bolt 19 is not in engagement with the strike 16 and can still be moved a predetermined distance for engagement with the strike as shown in FIG. 6 when it is desired to lock the door 14 to close the openings 13 in the front panel or section 12.

When the dead bolt 19 is moved so as to engage the strike 16 the plurality of transverse passages 41*a*, 41*b* and 41*c* will be brought into alignment with the circumferential locking groove 33 formed on the inner wall of the bore 32 in the dead bolt guide 31 so that the ball members 42*a*, 42*b* and 42*c* can be further urged radially outward by the plunger section 44 of the actuating assembly 43 due to the expansion of the resilient member 51 which is continuously acting against the plunger section 44.

Thus when the dead bolt 19 is moved to the locked or secured position as shown in FIG. 6, the ball members will be self actuated to interlock the dead bolt 19 so that it cannot be moved from the locked position.

In the locked position it will be clear that the door is held against the strike 16 on one side by the dead bolt 19 and on the opposite side the Z strip 20 acts as a corresponding securing mechanism. Thus even if the hinge 15 is removed the door 14 cannot be removed from the locked positon until the dead bolt 19 is released and unlocked.

When it is desired to unlock the door 14 so as to gain access to the security space 11, the combination lock assembly 25 is operated through the dial and handle member 28 by dialing the proper opening combination. This will also permit the dial or handle 28 to move the operating lever or live bolt 24 and coupling nut 52 to pull on the push rod 45 of the actuating assembly 43. The dial 28 is turned to move the operating lever or live bolt 24 until the circumferential transfer groove 48 is brought into alignment with the plurality of transverse passages 41*a*, 41*b* and 41*c* which causes the sized ball members 42*a*, 42*b* and 42*c* to drop out of engagement with the locking groove 33 and into the transverse passages 41*a*, 41*b* and 41*c*. This movement will occur against the 60° camming surface of the second transverse face 35 of the locking groove 33 thus permitting the dead bolt 19 to slide freely in the bore 32 until it disengages the strike 16 and moves to the unlocked position as is shown in FIG. 5 of the drawings.

Once the dead bolt 19 is in the unlocked position the door 14 may then be pivoted to the open position to permit access through opening 13 to the security space 11 of the safe depository 10.

When it is desired to relock the door 14, the door is pivoted on hinge 15 until it is brought into engagement with the strike 16 and the dial and handle 28 is then turned to cause the live bolt 24 through coupling nut 52 to push or release the push rod 45 thus permitting the resilient member or spring 51 to again bring the plunger section 44 to the point where the circumferential transfer groove 48 is again in alignment with the plurality of sized transfer passages 41*a*, 41*b* and 41*c*. As the dead bolt 19 now moves to engage the strike 16, the sized ball members 42*a*, 42*b* and 42*c* will again be moved radially outward by the 60° camming surface of the second transverse face 50 of the circumferential transfer groove 48 into the interlocking arrangement with the locking groove 33 on the inner wall of the transverse bore 32 as was described above.

Figure 8:
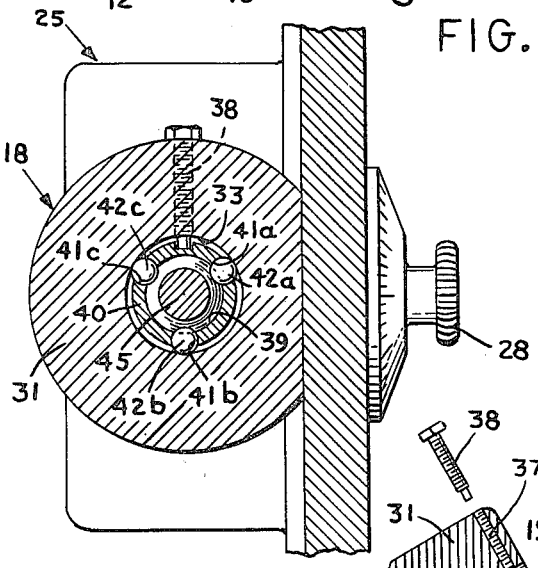
FIG. 8 is a cross section taken at line 8-8 of FIG. 6.
Figure 7:
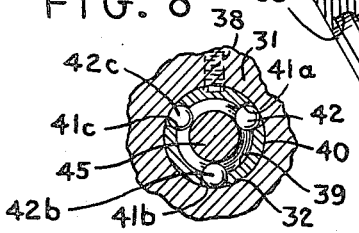
FIG. 7 is a cross section taken at line 7-7 of FIG. 5
Figure 9:
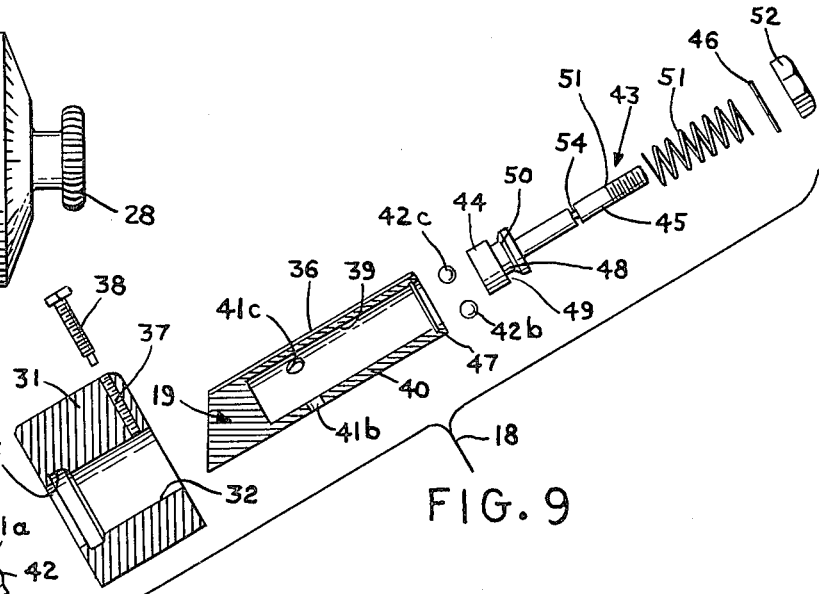
FIG. 9 is an exploded view of the elements forming the self interlocking dead bolt assembly.

The operative association of the locking groove 33, transverse passages 41*a*, 41*b* and 41*c*, and the ball members 42*a*, 42*b* and 42*c* requires that the transverse passages and the ball members be so sized that when the ball members are in the locked position as shown in FIGS. 6 and 8 of the drawings, the sized balls will lie partly in the locking groove and partly in the transverse passages.

Further, however sizing of the ball members must also be correlated with the available throw L of the live bolt 24 because the live bolt in the relatively cheap commercially available combination lock assemblies have only a limited throw. This is significant in the opening movement of the dead bolt assembly 18 as above described because the live bolt 24 first moves the actuating assembly 43 to release the balls 42*a*, 42*b* and 42*c* and then must move still further to slide the dead bolt 19 to the open position as shown in FIG. 5.

To illustrate, it has been determined that for a ¾" dead bolt that standard air gun shot having a diameter of 0.177" will be successful with at least one of the conventional combination lock assemblies which are readily available on the open market.

Thus, a relatively simple self interlocking dead bolt assembly has been disclosed. While this dead bolt assembly has been shown as applied to a safe depository it will be understood that it is adapted for any type of dead bolt locking arrangement where it is desirable to prevent the dead bolt from being moved from the locked position once the same has been set.

It will be understood that the invention is not to be limited to the specific construction or arrangement of parts shown but that they may be widely modified within the invention defined by the claims.

What is claimed is:

1. A self interlocking dead bolt assembly movable from an unlocked position to a locked position and vice versa relative a strike member comprising, a. bolt guide means having a bore end to end therethrough, and locking groove means inwardly of one end of said bore, b. an elongated dead bolt means slidably mounted in the bore of the bolt guide means for movement from the unlocked to the locked position and vice versa, c. said dead bolt means having a strike end and an elongated chamber extending inwardly from the end remote from the strike end to define an annular wall on said dead bolt means, d. transverse passage means in said annular wall a predetermined distance from the strike end of the dead bolt means, e. sized ball means operatively associated with said transverse passage means, f. an actuating means for moving the dead bolt from the unlocked to the locked position and vice versa, g. said actuating means also connected for relative movement with the dead bolt means to normally urge said sized ball means to move through said transverse passage means into engagement with said locking groove means to interlock the dead bolt in the locked position, and h. said ball members to move out of said locking groove and to return through said transverse passage means when said actuating means initiates movement of said dead bolt to the unlocked position.

2. In a self interlocking dead bolt assembly as claimed in claim 1 including, means on said actuating means to cause said ball means to move radially outward through said transverse passage means.

3. In a self interlocking dead bolt assembly as claimed in claim 2 wherein said means includes, a circumferential transfer groove in said actuating means adjacent the strike end of said dead bolt, and a transverse camming surface on at least one side of said circumferential transfer groove.

4. In a self interlocking dead bolt assembly as claimed in claim 3 wherein, said camming surface is at an approximate angle of 60° to the longitudinal line of axial movement of said dead bolt assembly.

5. In a self interlocking dead bolt assembly as claimed in claim 1 including, means to cause the ball members to move out of said locking groove and to return through said transverse passage means when said actuating means initiates movement of said dead bolt to the unlocked position.

6. In a self interlocking dead bolt assembly as claimed in claim 5 wherein said means to cause the ball members to move out of said locking groove includes, a camming surface on at least one side of said locking groove.

7. In a self interlocking dead bolt assembly as claimed in claim 6 wherein said camming surface is at an approximate angle of 60° to the longitudinal line of movement of said dead bolt assembly.

8. In a self interlocking dead bolt assembly as claimed in claim 1 wherein the actuating member includes, resilient means disposed to normally urge the actuating member into the elongated chamber towards the strike end of the dead bolt means and to permit the relative movement between the actuating member and the dead bolt means.

9. In a self interlocking dead bolt assembly as claimed in claim 8 wherein, a. said actuating member has a plunger section at the end thereof disposed in the elongated chamber of the dead bolt means, b. said plunger section has a circumferential groove about the periphery thereof having, a first transverse surface normal to the longitudinal line of the dead bolt means, and a second transverse surface spaced from said first transverse surface chamfered at about a 60° angle to the longitudinal axis of movement of said dead bolt means.

10. In a self interlocking dead bolt assembly as claimed in claim 8 wherein said locking groove means includes, a first surface normal to the longitudinal axis of said bore, and a second surface spaced from said first surface chamfered at about a 60° angle to the longitudinal axis of movement of said dead bolt means.

11. In a self interlocking dead bolt assembly as claimed in claim 1 wherein the dead bolt means includes breakaway means adapted to fracture on lateral or twisting movement applied to the dead bolt assembly.

12. In the combination as claimed in claim 11 wherein the breakaway means consists of a reducer diameter section on the actuating means.

13. The combination with a pivotally mounted door and a strike member of a self interlocking dead bolt movable to engage the strike member to hold the door in a closed and locked position and on disengagement of the strike member to permit the door to move to an open position including;

a. bolt guide means connected to one face of said door having a bore end to end therethrough, and locking groove means inwardly of one end of said bore, b. an elongated dead bolt means slidably mounted in the bore of the bolt guide means movable from the unlocked to the locked position and vice versa.

c. said dead bolt means having a strike end and an elongated chamber extending inwardly from the end thereof remote from the strike end to define an annular wall on said dead bolt means, d. transverse passage means disposed through said annular wall a predetermined distance from the strike end of the dead bolt means, e. sized ball means movable through said transverse passage means, f. an actuating means disposed in said elongated chamber for moving the dead bolt means from the unlocked to the locked position and vice versa, g. said actuating means also connected for relative movement with the dead bolt means to normally urge said ball means to move through said transverse passage means into engagement with said locking groove means to interlock said dead bolt as it is moved to the locked position, h. said ball members to move out of said locking groove means and to return to said transverse passage means when said actuating means initiates movement of said dead bolt means to the unlocked position, i. an operating means connected to the door having, an operating lever thereon, j. coupling means for connecting said actuating means to said operating member whereby on movement of the operating means the actuating means will move said dead bolt means from the unlocked to the locked position and vice versa.

14. The combination as claimed in claim 13 wherein said sized ball members have a diameter in ratio to the throw of movement of said operating member on the operating means.

15. The combination as claimed in claim 13 wherein said actuating member includes, means to urge said sized ball means radially outward through said transverse passage means.

16. In the combination as claimed in claim 13 wherein said locking groove means includes, a camming means thereon to permit said sized ball means to move radially inward through said transverse passage means when said actuating means initiates movement of said dead bolt means to the unlocked position.

17. In the combination as claimed in claim 13 wherein said locking groove means includes, a first surface normal to the longitudinal axis of said bore, and a second surface spaced from said first surface chamfered at about a 60° angle to the longitudinal axis of movement of said dead bolt means.

18. In the combination as claimed in claim 13 wherein, a. said actuating member has a plunger section at the end thereof in the elongated chamber, b. said plunger section having a circumferential groove about the periphery thereof having a first transverse surface normal to the longitudinal line of the dead bolt means, and a second transverse surface spaced from said first transverse surface chamfered at about a 60° angle to the longitudinal axis of of movement of the dead bolt means.

19. In the combination as claimed in claim 13 wherein the actuating member includes, resilient means disposed to normally urge the actuating member into the elongated chamber towards the strike end of the dead bolt means and to permit relative movement between the actuating member and said dead bolt means.

20. In the combination as claimed in claim 13 wherein the actuating member includes, breakaway means adapted to fracture on lateral or twisting movement applied to the dead bolt assembly.

21. In the combination as claimed in claim 20 wherein, a. the actuating member includes, a plunger section at the end thereof in the elongated chamber and a push rod disposed to extend exterially of the elongated chamber, b. the coupling means includes adjustable means comprising, a nut threaded on said push rod, and a T-slot in said operating member.

22. In the combination as claimed in claim 19 wherein said actuating means includes, a reduced diameter section on the push rod to provide a breakaway device designed to fracture on the application of side wise movement or twisting movement to said dead bolt assembly.

* * * * *